US009803645B2

(12) United States Patent
Ota et al.

(10) Patent No.: US 9,803,645 B2
(45) Date of Patent: Oct. 31, 2017

(54) COOLING FAN

(75) Inventors: Hidetake Ota, Kiryu (JP); Hiroshi Yokoyama, Kiryu (JP); Yukio Osawa, Kiryu (JP)

(73) Assignee: MITSUBA CORPORATION, Gunma (JP)

( * ) Notice: Subject to any disclaimer, the term of this patent is extended or adjusted under 35 U.S.C. 154(b) by 1038 days.

(21) Appl. No.: 13/813,856

(22) PCT Filed: Aug. 3, 2011

(86) PCT No.: PCT/JP2011/067764

§ 371 (c)(1),
(2), (4) Date: Apr. 1, 2013

(87) PCT Pub. No.: WO2012/018042

PCT Pub. Date: Feb. 9, 2012

(65) Prior Publication Data

US 2013/0209242 A1 Aug. 15, 2013

(30) Foreign Application Priority Data

Aug. 5, 2010 (JP) ..... 2010-176430

(51) Int. Cl.
*F01D 1/02* (2006.01)
*F04D 19/00* (2006.01)
(Continued)

(52) U.S. Cl.
CPC ..... *F04D 19/002* (2013.01); *F04D 29/164* (2013.01); *F04D 29/326* (2013.01); *F04D 29/666* (2013.01)

(58) Field of Classification Search
CPC ..... F04D 19/002; F04D 29/164
See application file for complete search history.

(56) References Cited

U.S. PATENT DOCUMENTS 855,131 A * 5/1907 Preidel ..... F04D 3/005 415/221
4,505,641 A * 3/1985 Tsuchikawa ..... F04D 29/326 415/173.6

(Continued)

FOREIGN PATENT DOCUMENTS

CN 101139996 3/2008
JP 2007-92562 4/2007

(Continued)

OTHER PUBLICATIONS

International Search Report dated Oct. 25, 2011 on the underlying Application No. PCT/JP2011/067764 with English translation thereof.

(Continued)

*Primary Examiner* — Phutthiwat Wongwian
*Assistant Examiner* — Matthew T Largi
(74) *Attorney, Agent, or Firm* — Andrews Kurth Kenyon LLP

(57) ABSTRACT

A cooling fan includes a boss section (12) connected to a rotary drive source, a plurality of blades (13) protruding outward from the boss section in a radial direction, and a cylindrical ring member (14) configured to annularly connect the vicinities of end sections outside in the radial direction of the plurality of blades. The plurality of blades (13) protruding outward from the boss section (12) in the radial direction are connected by the cylindrical ring member (14) in the vicinity of the end section outside in the radial direction. An air inlet groove (16) is formed at an end section in an axial direction of an air suction side of the ring member (14). The air inlet groove (16) is disposed between front regions in the rotation direction of all of the blades (13) on the ring member (14) and front regions in the rotation direction of the blades (13) adjacent thereto. The air flowing from the outer circumferential side passes through the air (Continued)

inlet groove (16) of the ring member (14) and gradually changes a direction to be suctioned between the blades (13).

20 Claims, 9 Drawing Sheets

(51) Int. Cl.
*F04D 29/16* (2006.01)
*F04D 29/32* (2006.01)
*F04D 29/66* (2006.01)

(56) References Cited

U.S. PATENT DOCUMENTS 5,405,243 A * 4/1995 Hurley ..... B63H 1/16 416/189
5,577,888 A * 11/1996 Capdevila ..... F04D 29/325 165/122
6,375,416 B1 4/2002 Farrell et al.
7,484,925 B2 * 2/2009 Carlson ..... F04D 29/661 415/119
2002/0141871 A1 * 10/2002 Medamaranahally F04D 29/326 416/193 R
2003/0123987 A1 7/2003 Longet
2007/0160459 A1 7/2007 Tudor
2010/0068060 A1 * 3/2010 Ota ..... F04D 29/325 416/179

FOREIGN PATENT DOCUMENTS

JP 2008-163888 7/2008
JP 2008163888 A * 7/2008
JP 2010-96084 4/2010
JP 2010096084 A * 4/2010
WO WO 2008/072516 6/2008

OTHER PUBLICATIONS

Office Action dated Nov. 18, 2014 in corresponding application CN No. 201180038424.1.

* cited by examiner

COOLING FAN

TECHNICAL FIELD

The present invention relates to a cooling fan used in a radiator or the like of an automobile.

This application claims priority to and the benefit of Japanese Patent Application No. 2010476430 filed on Aug. 5, 2010, the disclosure of which is incorporated by reference herein.

BACKGROUND ART

Many of such cooling fans have a basic structure in which a plurality of blades protruding outward in a radial direction are installed at a boss section connected to a rotary drive source such as an engine or an electric motor, and the blades are rotated by power of the rotary drive source to blow air to a cooled object.

Here, in such a cooling fan, while it is well known that fan efficiency is advantageously increased when the thickness of the blade is thinned, when the thickness of the blade is thinned, the blade is likely to be bent and cause flapping upon rotation.

For this reason, as a cooling fan configured to accomplish both of suppression of the flapping and thinning of the blade, a configuration in which the vicinities of the end sections outside in the radial direction of the plurality of blades are connected by a cylindrical ring member is proposed (for example, see Patent Document 1).

CITATION LIST

Patent Document

[Patent Document 1] Specification of International Patent Application, Publication No. 2008/072516

SUMMARY OF INVENTION

Problems to be Solved by Invention

In the cooling fan of the related art, since the vicinities of the end sections of the plurality of blades are connected to each other by the ring member, air flowing from an outer circumferential side moves over the ring member to be suctioned into a space between the blades.

However, in the case of the cooling fan of the related art, since the ring member connecting the plurality of blades has a cylindrical shape having substantially the same height as the blade, the air suctioned into the space between the blades from the outer circumferential side bypasses an end section of an air suction side of the ring member and then suddenly turns in an axial direction of the fan. Then, when the air flowing from the outer circumferential side suddenly turns at the end section of the ring member, the flow velocity of the air is locally increased at that area, easily causing noise generation.

In addition, in the cooling fan of the related art, since the air flowing from the outer circumferential side bypasses the end section of the air suction side of the ring member as described above to be suctioned into the space between the blades, a branch path through which the air bypasses the end section is lengthened, and the fan efficiency is likely to be decreased to that extent.

Here, the present invention is directed to provide a cooling fan capable of smoothly introducing air between the blades from the outer circumferential side, suppressing noise generation, and improving the fan efficiency.

Means for Solving the Problems

A cooling fan according to the present invention employs the following means for solving the problems.

According to a first aspect of the present invention, a cooling fan includes: a boss section connected to a rotary drive source; a plurality of blades protruding outward from the boss section in a radial direction; and a cylindrical ring member configured to annularly connect the vicinities of end sections outside in the radial direction of the plurality of blades, wherein an air inlet groove is formed at an end section in an axial direction of an air suction side of the ring member, a lightening groove is formed at an end section in an axial direction of the air ejection suction side so as to be offset with respect to of the air inlet groove in a circumferential direction.

Accordingly, the air flowing from the outer circumferential side passes through the air inlet groove of the ring member to be suctioned into a space between the blades. Since the air inlet groove is recessed with respect to a base level of the end section in the axial direction of the air suction side of the ring member, the air suctioned into the space between the blades from the outer circumferential side gradually changes a direction to the axial direction of the fan, without abrupt turning.

According to a second aspect of the present invention, in the cooling fan according to the first aspect of the present invention, the air inlet groove is disposed between front regions in the rotation direction of all of the blades on the ring member and front regions in the rotation direction of the blades adjacent thereto.

According to a third aspect of the present invention, in the cooling fan according to the first or the second aspects of the present invention, a bottom section of the air inlet groove is recessed by a predetermined depth with respect to a base level which has substantially the same height as one end in an axial direction of the blade formed at the ring member in an axial direction of an air suction side of the ring member, a bottom section of the lightening groove is formed to be recessed by a predetermined depth with respect to a base level which has substantially the same height as one end in an axial direction of the blade formed at the ring member in an axial direction of the air ejection suction side of the ring member, and each of the bottom section of the air inlet groove and each of the bottom section of the lightening groove are formed at a offset position in a circumferential direction.

According to a fourth aspect of the present invention, in the cooling fan according to any one of the first to the third aspects of the present invention, the depths of the air inlet groove and the lightening groove are set to the same depth.

According to a fifth aspect of the present invention, in the cooling fan according to any one of the first to fourth aspects of the present invention, the ratio between the depth of the air inlet groove and the thickness in the axial direction of the ring member is set to be in a range of 0.10 to 0.40.

According to a sixth aspect of the present invention, in the cooling fan according to any one of the first to fifth aspects of the present invention, at the end section in the axial direction of the air ejection side in the ring member, a wall section extending outward in the axial direction of a base level which has substantially the same height as one end in an axial direction of the blade formed at the end section in the axial direction of the air ejection side in the ring member is formed at a place corresponding to a rear region in the rotation direction of the blade.

According to a seventh aspect of the present invention, in the cooling fan according to sixth aspect of the present invention, when the height from the lightening groove to the base level which has substantially the same height as one end in an axial direction of the blade formed at the end section in the axial direction of the air suction side of the ring member is set to h, the height from the air inlet groove to a front end of the wall section is set to be in a range of 1.2 h to 1.3 h.

According to an eighth aspect of the present invention, in the cooling fan according to the sixth or the seventh aspects of the present invention, the wall section curvedly extends from the base level of the air ejection side in the ring member serving as a base point.

According to a ninth aspect of the present invention, in the cooling fan according to the eighth aspect of the present invention, an angle between the ring member and the wall section is set to be in a range of 15 to 30 degrees.

According to a tenth aspect of the present invention, in the cooling fan according to any one of the sixth to ninth aspects of the present invention, the wall section is formed between the rear regions in the rotation direction of all of the blades on the ring member and the lightening grooves formed at positions corresponding to the rear regions.

According to an eleventh aspect of the present invention, a cooling fan includes: a boss section connected to a rotary drive source; a plurality of blades integrally formed with the boss section and formed outward in a radial direction; and a cylindrical ring member configured to annularly connect end sections outside in the radial direction of the plurality of blades, wherein an air inlet groove is formed so as to be recessed by a predetermined depth with respect to a surface of an end section in an axial direction of an air suction side of the ring member, and a lightening groove is formed at an end section in an axial direction of the air ejection suction side so as to be offset with respect to of the air inlet groove and each of the bottom section of are formed at a offset position in a circumferential direction.

Effects of Invention

According to the present invention, since the air inlet groove is formed at the end section in the axial direction of the air suction side of the ring member and the air flowing from the outer circumferential side passes through the air inlet groove of the ring member and changes a direction to the axial direction to be suctioned into the space between the blades, without abruptly turning, an increase in flow velocity of the air due to the abrupt turning of the air can be suppressed, and generation of noise can be prevented in advance. In addition, according to the present invention, since the air flowing from the outer circumferential side is suctioned between the blades through the air inlet groove, without largely bypassing the end section in the axial direction of the ring member, the fan efficiency can be securely improved. Further, according to the present invention, since a lightening groove is formed at the end section in the axial direction of the air ejection side of the ring member to deviate from the air inlet groove in a circumferential direction, the weight balance in the circumferential direction can be further increased.

According to the second aspect of the present invention, since the air inlet groove is disposed between the front regions in the rotation direction of all of the blades on the ring member and the front regions in the rotation direction of the blades adjacent thereto, the air from the outer circumferential side of the ring member can be efficiently and uniformly suctioned, and the weight balance in the circumferential direction can be maintained well.

According to the third aspect of the present invention, since a bottom section of the air inlet groove is recessed by a predetermined depth with respect to a base level which has substantially the same height as one end in an axial direction of the blade formed at an end section in an axial direction of an air suction side of the ring member, a bottom section of the lightening groove is formed to be recessed by a predetermined depth with respect to a base level which has substantially the same height as one end in an axial direction of the blade formed at an end section in an axial direction of the air ejection suction side of the ring member, and each of the bottom section of the air inlet groove and each of the bottom section of the lightening groove are formed at a offset position in a circumferential direction, the weight balance in the circumferential direction can be further increased and the ring member can be easily die-formed due to the air inlet groove and the lightening groove having bottom sections.

According to the fourth aspect of the present invention, since the depths of the air inlet groove and the lightening groove are set to the same depth, the weight balance in the circumferential direction can be further increased.

According to the fifth aspect of the present invention, generation of noise can be securely prevented, and a decrease in fan efficiency can be prevented.

According to the sixth aspect of the present invention, since the wall section is formed at the end section in the axial direction of the air ejection side in the ring member at the place corresponding to the rear region in the rotation direction of the blade, even when the air passes through the end section of the rear side in the rotation direction of the blade, discharge of the air to the outside of the ring member can be suppressed. For this reason, the noise of the fan can be more securely reduced.

According to the seventh aspect of the present invention, as the height of the wall section in an axial direction is restricted, the noise of the fan can be effectively reduced.

According to the eighth aspect of the present invention, as the wall section curvedly extends from the base level of the end section in the axial direction of the air ejection side of the ring member, the noise of the fan can be securely reduced without lowering the fan efficiency.

According to the ninth aspect of the present invention, as the angle of the wall section is restricted, the noise of the fan can be effectively reduced.

According to the tenth aspect of the present invention, since the wall section is formed between the rear regions in the rotation direction of all of the blades on the ring member and the lightening grooves formed at positions corresponding to the rear regions, even when the ring member has the lightening groove, the wall section can be laid out therewith. For this reason, the degree of design freedom can be improved, and the noise of the fan can be reduced.

According to the eleventh aspect of the present invention, an increase in flow velocity of the air due to abrupt turning of the air can be suppressed, and generation of the noise can be prevented in advance. In addition, the fan efficiency can be securely improved.

BEST MODE OF CARRYING OUT THE INVENTION

First Embodiment

Hereinafter, a first embodiment of the present be described based on FIG. 1 to FIG. 5.

Figure 1:
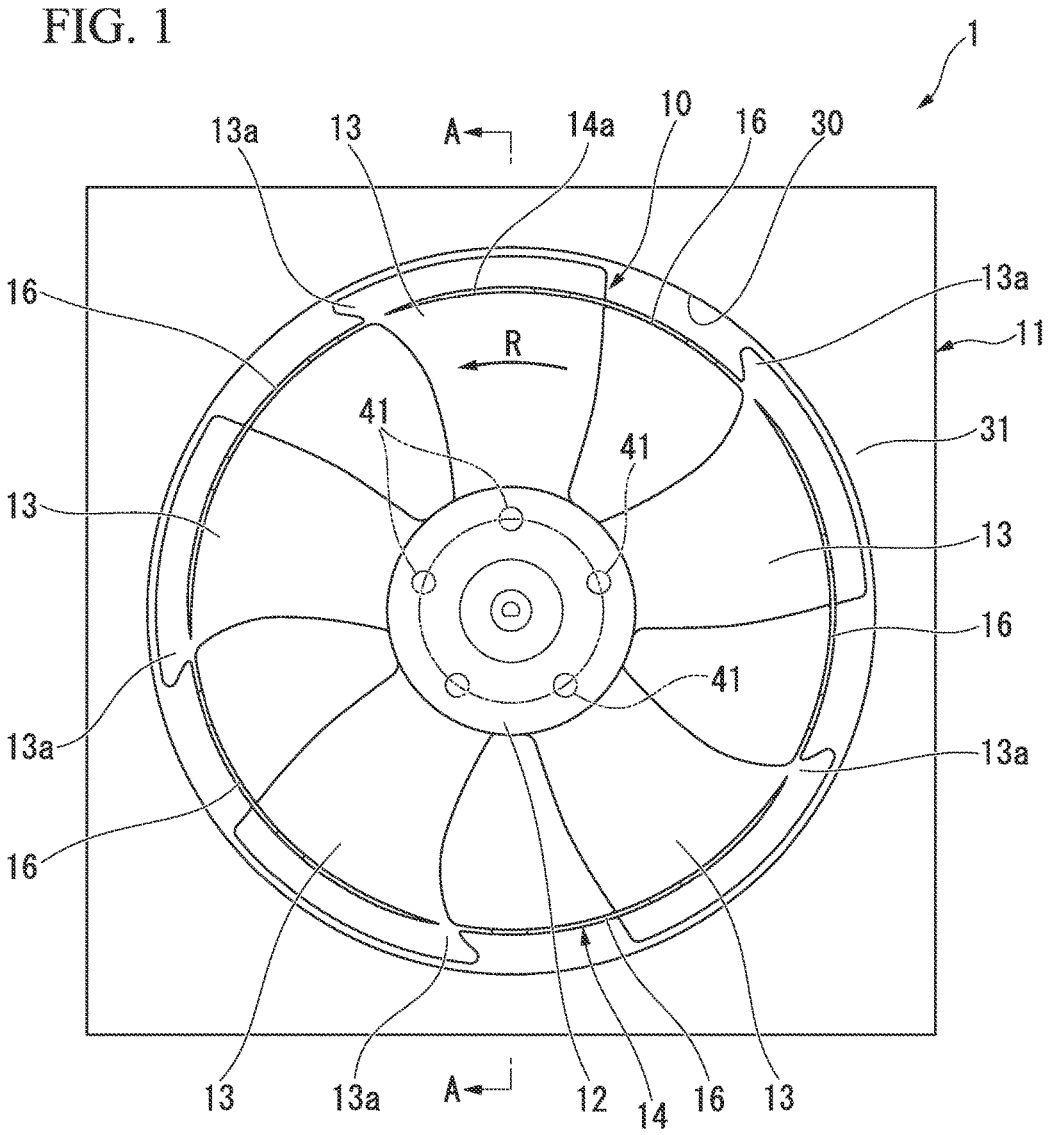
FIG. 1 is a front view of a cooling fan according to a first embodiment of the present invention.
Figure 2:
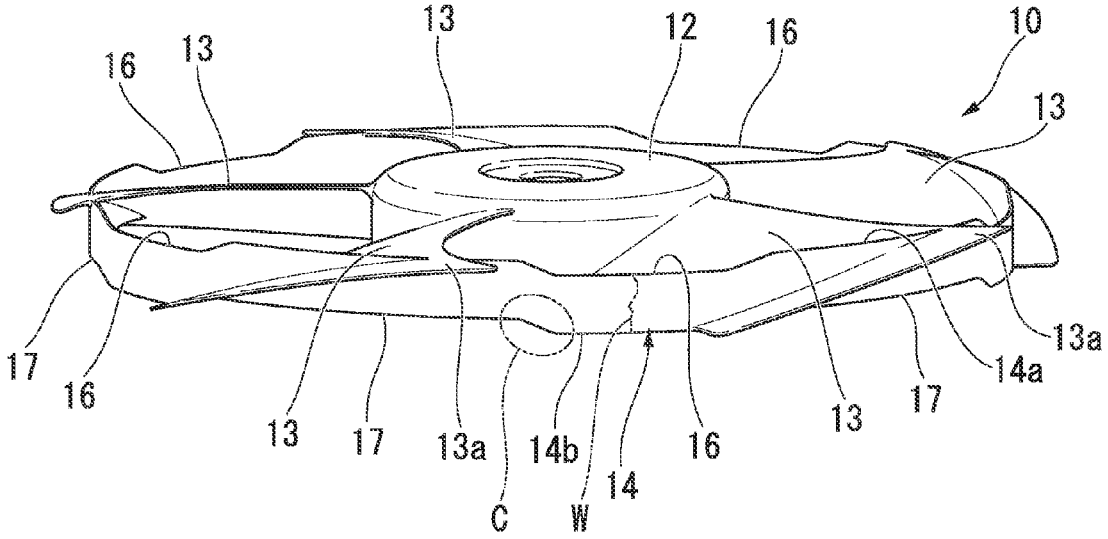
FIG. 2 is a perspective view of a fan main body of the cooling fan according to the first embodiment of the present invention.
Figure 3:
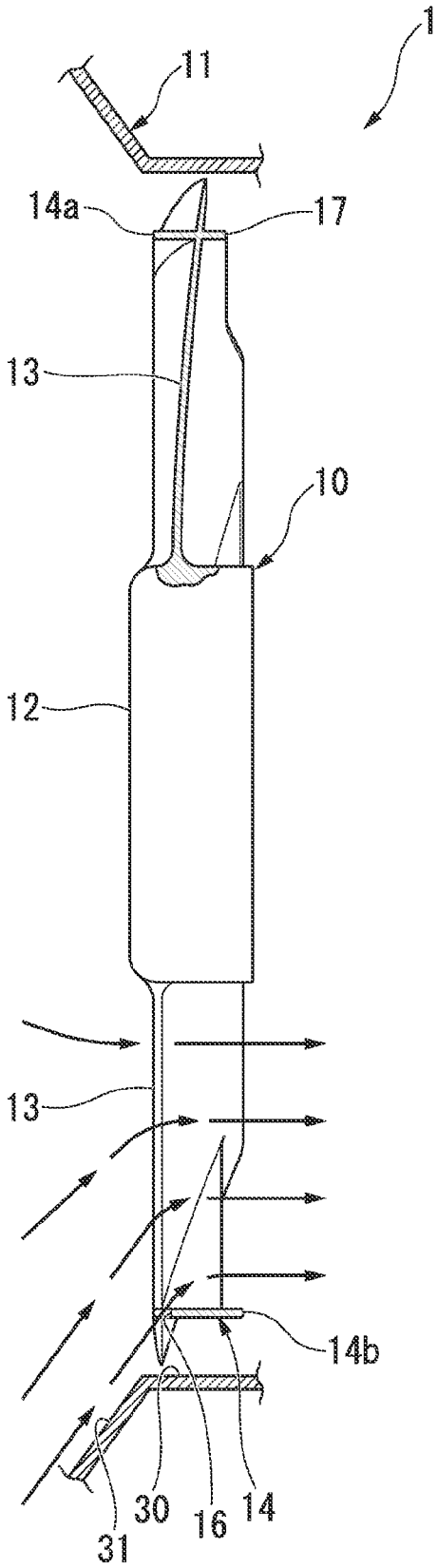
FIG. 3 is a cross-sectional view corresponding to a cross section taken along line A-A of FIG. 1 of the cooling fan according to the first embodiment of the present invention.

FIG. 1 is a view of a cooling fan 1 according to the first embodiment when seen from a front side, FIG. 2 is a perspective view showing a fan main body 10 of the cooling fan 1, and FIG. 3 is a view showing a cross section of the cooling fan 1.

The cooling fan 1 of the first embodiment is an axial flow fan used in a radiator of an automobile, and includes the fan main body 10 rotary-driven by a rotary drive source such as an engine or an electric motor, which are not shown, and a shroud 11 configured to cover an outer circumferential side of the fan main body 10 and increase introduction efficiency of air with respect to the radiator.

The shroud 11 has a circular flow guide hole 30 formed at a substantially central portion of a front surface thereof and having a depth in an axial direction of the fan main body 10, and the fan main body 10 is rotatably disposed inside a circumferential wall surface of the flow guide hole 30. In addition, as shown in FIG. 3, a region surrounding the flow guide hole 30 of the front surface of the shroud 11 becomes a tapered surface 31 recessed toward the flow guide hole 30.

The fan main body 10 includes a bottomed cylindrical boss section 12 connected to an output shaft of a rotary drive source, a plurality of blades 13 (in the case of the first embodiment, the number of blades is five, each integrally formed with an outer circumferential surface of the boss section 12) integrally protruding outward from the outer circumferential surface of the boss section 12 in the radial direction, and a cylindrical ring member 14 annularly connecting end section regions outside in the radial direction of the plurality of blades 13. (In the case of the first embodiment, the ring member 14 annularly connects positions offset more inward in the radial direction than the end sections outside in the radial direction of the blade 13.)

Here, in the fan main body 10, a surface of the shroud 11 exposed to the outside (a surface when seen in a front view of FIG. 1) is referred to as a front surface and a surface of a rear side is referred to as a rear surface, each of the blades 13 is inclined such that a front side in a rotation direction of the fan main body 10 shown by an arrow R of FIG. 1 is opened toward the front surface of the fan main body 10. Accordingly, the rear surface side of the blade 13 becomes a positive pressure surface, and the front surface side of the blade 13 becomes a negative pressure surface. In addition, in each of the blades 13, an elevation angle is set to be large and a chord length is set to be small at the base side, and the elevation angle is set to be gradually reduced and the chord length is set to be gradually increased toward an extending end side. Then, the extending end of each of the blades 13 is formed to have an arc shape outlining a circle concentric with the boss section 12 when seen from a front view, such that a substantially constant micro gap is maintained with respect to the inner circumferential side of the flow guide hole 30 of the shroud 11.

In addition, while the blade 13 of the first embodiment is a forward-swept blade type in which the extending end side is curved toward a front side in the rotation direction when seen from a front view, in particular, the edge section of a front side in the rotation direction has a swelling amount to the front side that is increased toward the extending end. Hereinafter, a region in which a swelling amount is increased is referred to as "a swelling region 13*a*."

The ring member 14 has a plurality of air inlet grooves 16 formed at an end section an axial direction of an air suction side (a front surface side of the fan main body 10), and a plurality of lightening grooves 17 similarly formed at an end section in an axial direction of an air ejection side (a rear surface side of the fan main body 10).

A base level 14*a* of the end section in the axial direction of the air suction side of the ring member 14 is formed at substantially the same height as one end (an end section of a left side in FIG. 3) in the axial direction of the blade 13, and a bottom section of the air inlet groove 16 is recessed by a predetermined depth with respect to the base level 14*a*. The respective air inlet grooves 16 are formed between the swelling region 13*a* of the one blade 13 and the swelling region 13*a* of another blade 13 adjacent thereto in a circumferential region of the ring member 14. The respective air inlet grooves 16 are installed at a circumferential region of the ring member 14 at equidistant intervals. In addition, in the first embodiment, while the base level 14*a* of the end section in the axial direction of the air suction side of the ring member 14 is formed at substantially the same height as one end in the axial direction of the blade 13, the base level 14*a* may have a different height from the one end in the axial direction of the blade 13.

In addition, a base level 14*b* of the end section in the axial direction of the air ejection side of the ring member 14 is formed at substantially the same height as the other end (an end section of a right side in FIG. 3) in the axial direction of the blade 13, and a bottom section of the lightening groove 17 is formed to be recessed by a predetermined depth with respect to the base level 14*b*. Each of the lightening grooves 17 is formed at a position facing the positive pressure surface of each of the blades 13 and a position which at least the bottom section is offset on the ring member 14 toward the bottom section of the air inlet groove 16 in the circumferential direction. The respective lightening grooves 17 are formed at the circumferential region of the ring member 14 at equidistant intervals. Further, in the first embodiment, while the base level 14*b* of the end section in the axial direction of the air ejection side of the ring member 14 is also formed at substantially the same height as the other end in the axial direction of the blade 13, the base level 14*b* may be formed at a different height from the other end in the axial direction of the blade 13.

In addition, the air inlet groove 16 and the lightening groove 17 are formed in a front-open type trapezoidal shape having inclined surfaces, rather than a square-shaped groove. Accordingly, upon formation of the fan main body 10, the ring member 14 can be easily die-formed.

Further, in the case of the first embodiment, the air inlet groove 16 and the lightening groove 17 are set to the same depth. However, the depths of the air inlet groove 16 and the lightening groove 17 may be different.

Next, a method of manufacturing the fan body 10 of the cooling fan 1 will be described.

The fan main body 10 is a resin-cast product formed of a resin material such as polypropylene, which is formed by filling the resin material into upper and lower molds. A plurality of (for example, five in the first embodiment) gates 41 (see a two-dotted line of FIG. 1) configured to inject a resin material are formed at the upper mold. As shown in FIG. 1, specifically, a formation position of the gate 41 is a formation position of a cylindrical bottom surface of the boss section 12, and is disposed at a base area in which the plurality of blades 13 are integrally formed.

Then, after the upper and lower molds are assembled, the resin material melted at a high temperature is injected from the gates 41, and the resin material is sequentially filled into a space forming the boss section 12 and spaces forming the plurality of blades 13. Next, the resin material is finally filled in a space forming the ring member 14. Here, the resin material injected from the neighboring gates 41 is joined around a center area of the ring member 14 between the neighboring blades 13 via the spaces forming the blades 13.

As described above, the fan main body 10 of the cooling fan 1 is formed to have a bonding area (weld) W of the resin around the center area of the ring member 14 between the neighboring blades 13 (see a two-dotted line in FIG. 2).

In the above-mentioned configuration, when the fan main body 10 of the cooling fan 1 is rotary-driven, as shown by an arrow of FIG. 3, the air is suctioned into the space between the blades 13 from mainly the front side of the flow guide hole 30 of the shroud 11, and the air is supplied to a radiator (not shown) disposed at a rear side of the fan main body 10.

Here, the air flows into the flow guide hole 30 of the shroud 11 from the outer circumferential side of the shroud 11 as well as the front side. The air flowing from the outer circumferential side of the shroud 11 moves in a direction of the flow guide hole 30 along the tapered surface 31 of the front surface of the shroud 11, and passes through the air inlet groove 16 formed at the ring member 14 of the fan main body 10 to be suctioned between the blades 13, being ejected in the axial direction.

Since the air flowing from the outer circumferential side of the shroud 11 passes through the air inlet groove 16, which is lower than the base level 14*a* of the end section of the ring member 14, to be suctioned between the blades 13, the direction of the air is smoothly varied to the axial direction, without abruptly turning at the portion of the ring member 14. For this reason, in the case of the cooling fan 1, the flow velocity of the air flowing from the outer circumferential side of the shroud 11 is not abruptly increased at the portion of the ring member 14.

Accordingly, in the cooling fan 1, generation of noise due to an abrupt increase in the flow velocity of the air at the portion of the ring member 14 can be prevented in advance.

In addition, in the case of the cooling fan 1, since the air flowing from the outer circumferential side of the shroud 11 passes through the portion of the air inlet groove 16 securing a sufficient air passage area to be suctioned between the blades 13 with the shortest distance, the flow resistance of the air can be reduced, and the fan efficiency can be sufficiently improved to that extent.

Further, in the cooling fan 1, since the air inlet grooves 16 are disposed between front regions in the rotation direction of all of the blades 13 on the ring member 14 and front regions in the rotation direction of the blades 13 adjacent thereto, the air can be efficiently and uniformly suctioned into the fan main body 10 from the outer circumferential side of the ring member 14, and the weight balance (a rotation balance) in the circumferential direction of the fan main body 10 can become better.

Further, in the cooling fan 1, since the lightening groove 17 is formed at the end section in the axial direction of the air ejection side of the ring member 14 to deviate from the air inlet groove 16 in the circumferential direction, the weight balance in the circumferential direction of the ring member 14 becomes better.

In particular, in the case of the first embodiment, since depths of the air inlet groove 16 and the lightening groove 17 are set to be the same depth and a thickness in the axial direction of the ring member 14 is uniform in substantially the entire circumferential direction, the weight balance in the circumferential direction of the ring member 14 becomes better.

Here, an experimental result in which a relation between a depth of the air inlet groove 16 formed at the ring member 14, fan efficiency and fan noise are examined will be described.

Figure 4:
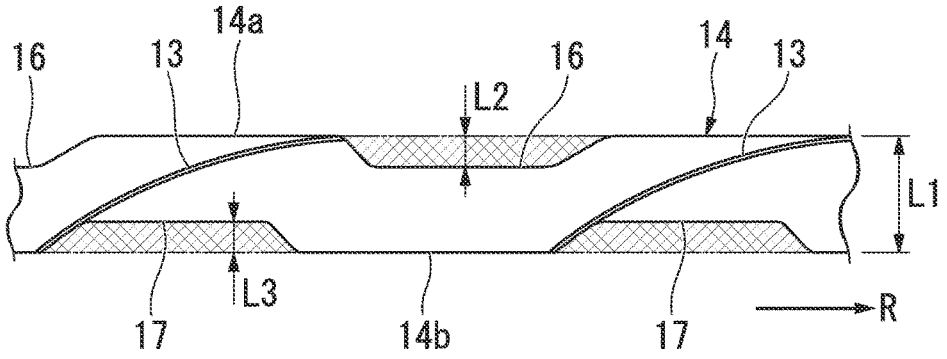
FIG. 4 is a schematic side view of the fan main body of the cooling fan according to the first embodiment of the present invention.

FIG. 4 is a view showing a dimensional relation of the respective parts of the cooling fan used in the experiment.

In FIG. 4, L1 represents a thickness in the axial direction of the ring member 14, L2 represents a depth of the air inlet groove 16, and L3 represents a depth of the lightening groove 17.

Here, L2/L1 was provided as a ring removal ratio and the ring removal ratio was varied from 0 to 1, and fan efficiency and fan noise were measured. In addition, L3/L1 was set to be equal to L2/L1.

Figure 5:
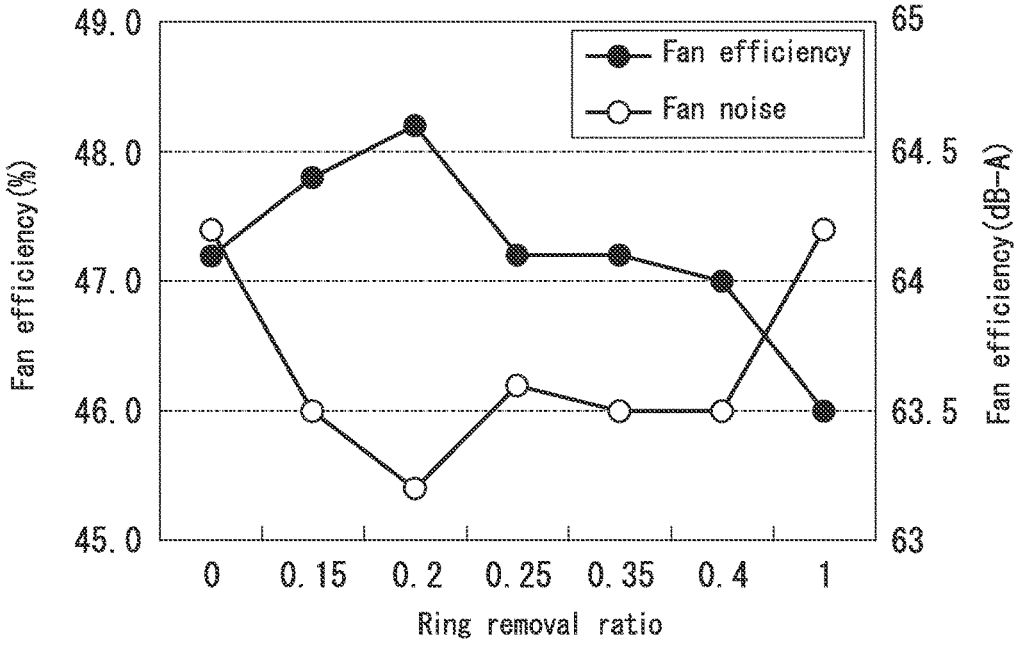
FIG. 5 is a graph showing a result obtained through examination of fan efficiency and fan noise by varying the depth of an air inlet groove of the cooling fan according to the first embodiment of the present invention.

FIG. 5 is a graph showing the experiment result at this time.

As will be apparent from the graph of FIG. 5, all of the fan efficiency and the fan noise can have good results within a range of 0.10 to 0.40 of the removal ratio L2/L1, and in particular, a particularly better result can be obtained within a range of 0.15 to 0.25.

Meanwhile, when the fan main body 10 of the cooling fan is rotary-driven, the following event is generated between the neighboring blades 13.

Describing using FIGS. 2 and 4, when the fan main body 10 is rotated in a direction of an arrow R, a rear side in the rotation direction of the blade 13 receives a stress in a downward direction of the drawing (a positive pressure surface side) by a stress (a force suctioned to the positive pressure surface side) for flowing the passing air to the positive pressure surface side. On the other hand, a front side in the rotation direction of the blade 13 cuts the air to flow the air between the blades 13, and receives a stress in an upward direction of the drawing (a negative pressure surface side).

That is, the front side and the rear side in the rotation direction of the blade 13 have different stress-receiving directions, and a torsional stress is generated from all of the blades 13. Then, the stress is concentrated around the center area with respect to the ring member 14 connecting between the blades 13.

Here, in a process of manufacturing the fan main body 10 as described above, the temperature of the injected resin material is slightly lowered at the arrival time at the ring member 14 in comparison with the temperature of the injected resin material at the time of injection into the gate. For this reason, the strength of the bonding areas W (five areas in the first embodiment) of the resins in the fan main body 10 may be varied.

In consideration of the above-mentioned circumstances, when the fan main body 10 is rotary-driven, it is necessary that the strength of the fan main body 10 is increased such that the stress applied to the ring member 14 is not concentrated on the bonding area W of the resins of the ring member 14. For this reason, the used resin material itself may have a high level of bonding strength, the thickness of the ring member 14 may be increased, or the length in the axial direction may be increased.

However, as described above, as the cost of the resin material increased or the use amount of the resin is increased, the cost of the fan main body 10 may be resultantly increased.

In general, when an object has a changing point (a folding point) of the shape, the stress applied to the object tends to be dispersed to the changing point side. Here, in the first embodiment, the air inlet groove 16 is formed at the air suction side of the ring member 14, and the lightening groove 17 is formed at the air ejection side. For this reason, in the above task, the applied stress can be dispersed around changing points C of the grooves 16 and 17 (see FIG. 2). Accordingly, the strength of the fan main body 10 can be secured with no increase in cost.

Second Embodiment

Next, a second embodiment of the present invention will be described based on FIG. 6. In addition, the same elements as the first embodiment are designated and described with reference numerals (as well as in subsequent embodiments).

Figure 6:
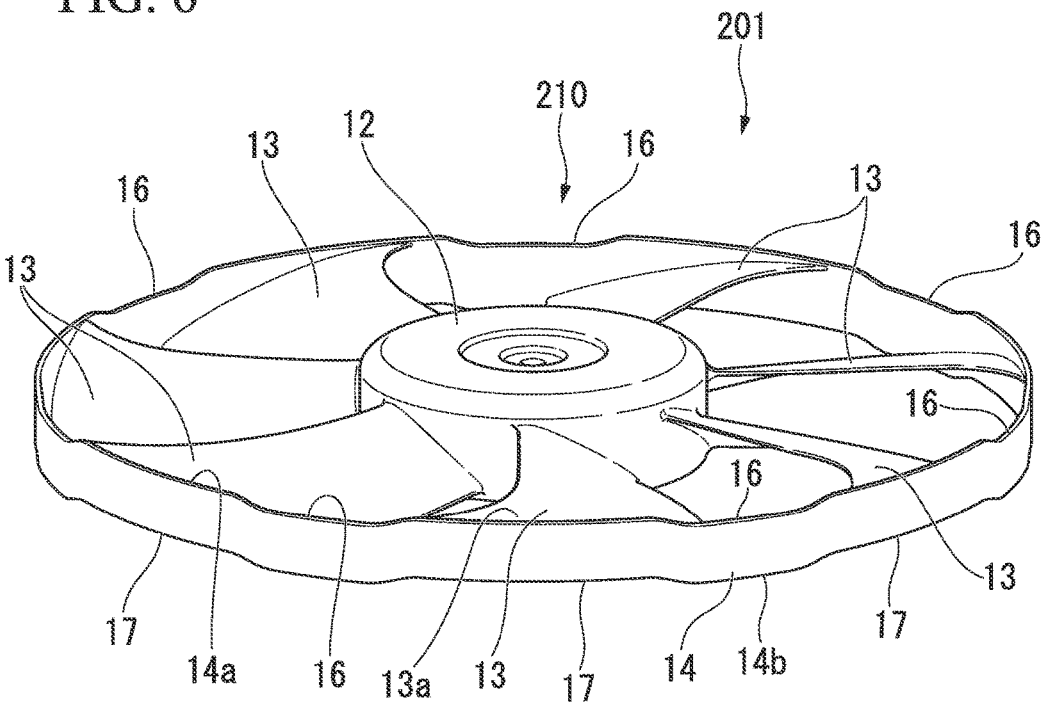
FIG. 6 is a perspective view of a fan main body of a cooling fan according to a second embodiment of the present invention.

FIG. 6 is a perspective view showing a fan main body 210 of a cooling fan 201 of the second embodiment.

As shown in FIG. 6, the second embodiment has the same basic configurations as the above-mentioned first embodiment (as well as in subsequent embodiments) in that the cooling fan 201 is an axial flow fan used in a radiator of an automobile and includes the fan main body 210 rotary-driven by a rotary drive source such as an engine or an electric motor, which are not shown, and a shroud (not shown in FIG. 6) configured to cover an outer circumferential side of the fan main body 210 and increase introduction efficiency of air with respect to the radiator, and the fan main body 210 includes a bottomed cylindrical boss section 12 connected to an output shaft of the rotary drive source, a plurality of blades 13 integrally protruding outward from the outer circumferential surface of the boss section 12 in a radial direction, and a cylindrical ring member 14 configured to annularly connect end section regions outside in the radial direction of the plurality of blades 13.

Here, the fan main body 210 of the second embodiment is distinguished from the fan main body 10 of the first embodiment in that, while the ring member 14 of the first embodiment annularly connects positions offset more inward in the radial direction than end sections outside in the radial direction of the blades 13, the ring member 14 of the second embodiment annularly connects the end sections outside in the radial direction of the blades 13.

Accordingly, in the cooling fan 201, in addition to the same effects as in the above-mentioned first embodiment, suction or ejection of the air can be controlled using all of the blades 13, noise of the cooling fan 1 can be more effectively prevented, and the fan efficiency can be improved.

Third Embodiment

Next, a third the present invention will be described based on FIG. 7 to FIG. 9.

Figure 7:
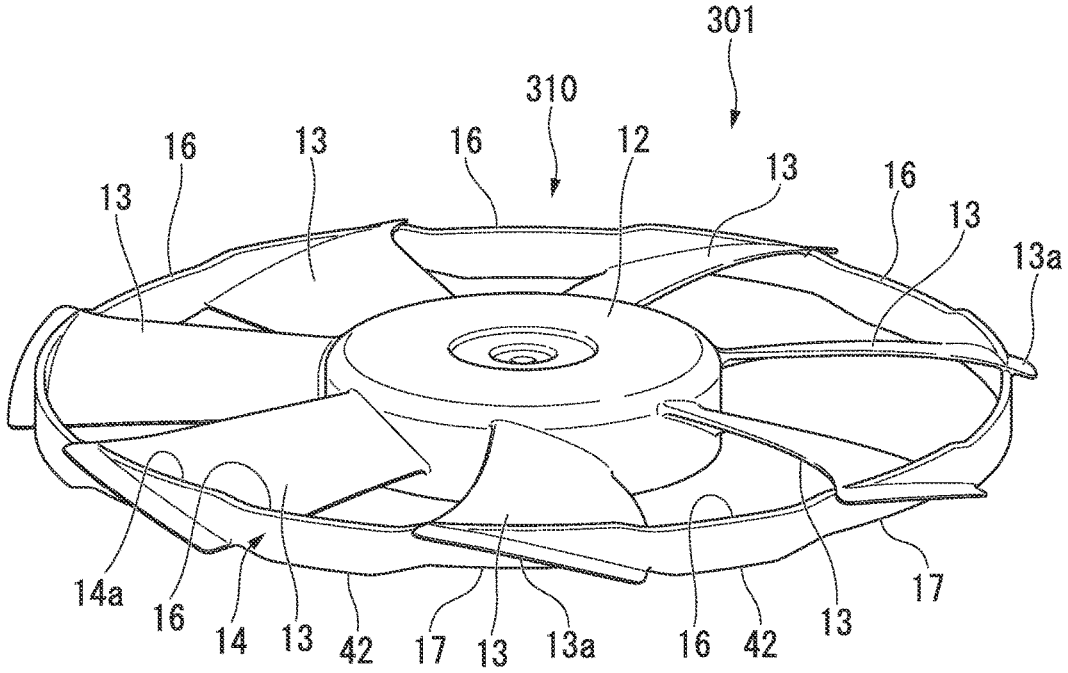
FIG. 7 is a perspective view of a fan main body of a cooling fare according to a third embodiment of the present invention.
Figure 8:
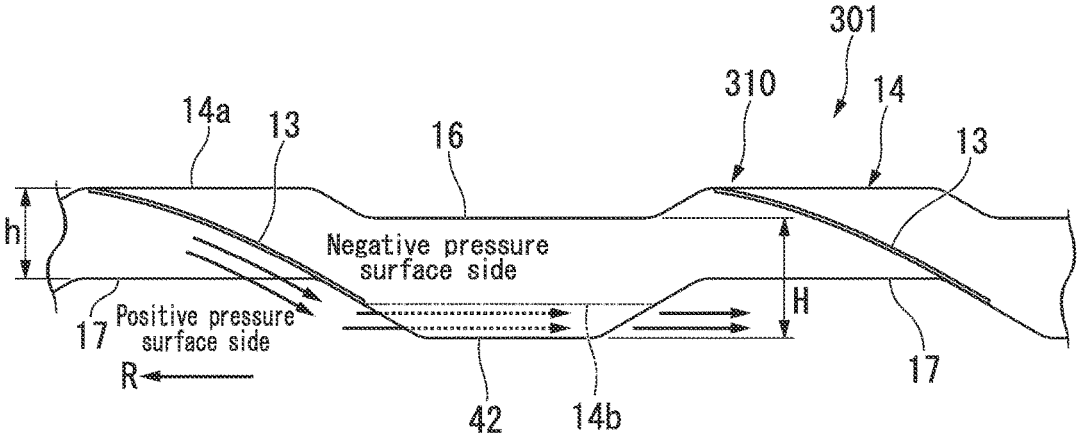
FIG. 8 is a schematic side view of the fan main body of the cooling fan according to the third embodiment of the present invention.

FIG. 7 is a perspective view showing a fan main body 310 of a cooling fan 301 of the third embodiment, and FIG. 8 is a view showing a dimensional relationship of the respective parts of the cooling fan 301.

As shown in FIGS. 7 and 8, the third embodiment is distinguished from the first embodiment n that, at the fan main body 310 of the cooling fan 301 according to the third embodiment, while a wall section 42 is formed at the end section in the axial direction of the air ejection side of the ring member 14, the wall section 42 is not formed in the first embodiment.

The wall section 42 will be described in more detail.

The wall section 42 extends from a base level 14*b* of the end section in the direction of the air ejection side of the ring member 14 in the axial direction. Then, the wall section 42 is disposed between a rear region in the rotation direction (the direction of an arrow R in FIG. 8) of all of the blades 13 and a lightening groove 17 formed at a position corresponding to each of the rear region. In other words, the wall section 42 is an end section of the air ejection side of the ring member 14, which is disposed at a position substantially overlapping the air inlet groove 16 in the axial direction.

Further, in the wall section 42, both side surfaces in the circumferential direction are inclined to be disposed on extension lines of side surfaces in the circumferential direction of the lightening groove 17, entirely forming a trapezoidal shape, which is narrowed toward the end.

In the above-mentioned configuration, when the fan main body 310 of the cooling fan 301 is rotary-driven, the air from the air suction side (a front surface side of the fan main body 310, i.e., an upper side of FIG. 8) of the cooling fan 301 is suctioned into the space between the blades 13, and the air is discharged to the air ejection side (a rear surface side of the fan main body 310, i.e., a lower side of FIG. 8) of the fan main body 310. Here, the air flows along the blade 13 inside in the radial direction of the ring member 14 of the blade 13, and inside the positive pressure surface. Then, when the air passes the edge section of the rear side in the rotation direction, the air flows to the outside of the ring member 14 by an initial force.

Here when the wall section 42 is not formed at the ring member 14, the air flows to the outside in the radial direction of the member 14, and further flows into the negative pressure surface side of the fan main body 310. In this case, since a blade edge vortex is generated, noise of the cooling fan 301 is increased.

However, in the third embodiment, since the wall section 42 is formed at a predetermined position of the ring member 14, the air ejected from the blade 13 is interfered with by the wall section 42 and does not easily flow to the outside in the radial direction of the ring member 14.

Accordingly, in the cooling fan 301, in addition to the same effects as in the above-mentioned first embodiment, since the air ejected from the blade 13 is interfered with by the wall section 42 and does not easily flow to the outside in the radial direction of the ring member 14, the noise of the cooling fan 301 can be more securely reduced.

In addition, the wall section 42 is disposed between rear regions in the rotation direction (a direction of an arrow R of FIG. 8) of all of the blades 13 and the lightening grooves 17 formed at positions corresponding to the rear regions. As described above, even in the ring member 14 having the lightening grooves 17 therein, the wall section 42 can be laid out with the lightening groove 17, and the degree of design freedom can be increased.

Here, an experiment result in which a relation between a height H of the wall section 42 formed at the ring member 14 and fan noise are examined will be described based on FIG. 8 and FIG. 9.

In FIG. 8, h represents a height from the lightening groove 17 to the base level 14*a* of the end section in the axial direction of the air suction side of the ring member 14. In addition, the height H of the wall section 42 represents a height in a direction from the air inlet groove 16 to a front end of the wall section 42. Then, the height of the wall section 42 was varied to 1.2 h and 1.3 h, and the fan noise in these cases was compared with that of the case in which there was no wall section 42 (the present h)

Figure 9:
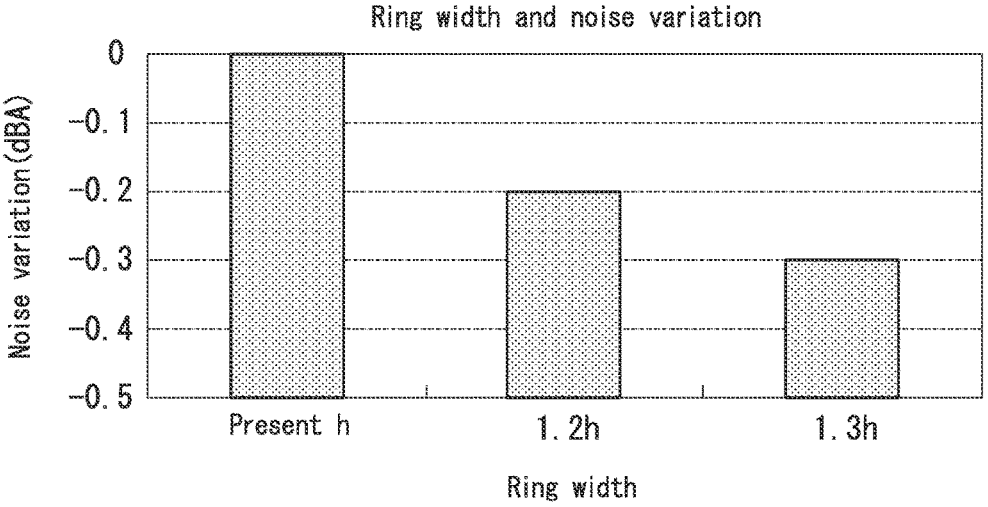
FIG. 9 is a graph showing a result obtained through examination of fan noise by varying the height of a wall section according to the third embodiment of the present invention.

FIG. 9 is a graph showing the experiment result.

As will be apparent from the drawing, when the height of the wall section 42 is set to a range of 1.2 h to 1.3 h, a result in which the fan noise is appropriately reduced in comparison with that of the case of no wall section 42 was obtained.

Accordingly, the height H of the wall section 42 may be set to a range of 1.2 h to 1.3 h with respect to the height h from the lightening groove 17 to the base level 14*a* of the end section in the axial direction of the air suction side of the ring member 14.

Fourth Embodiment

Next, a fourth embodiment of the present invention be described based on FIG. 10 to FIG. 13.

Figure 10:
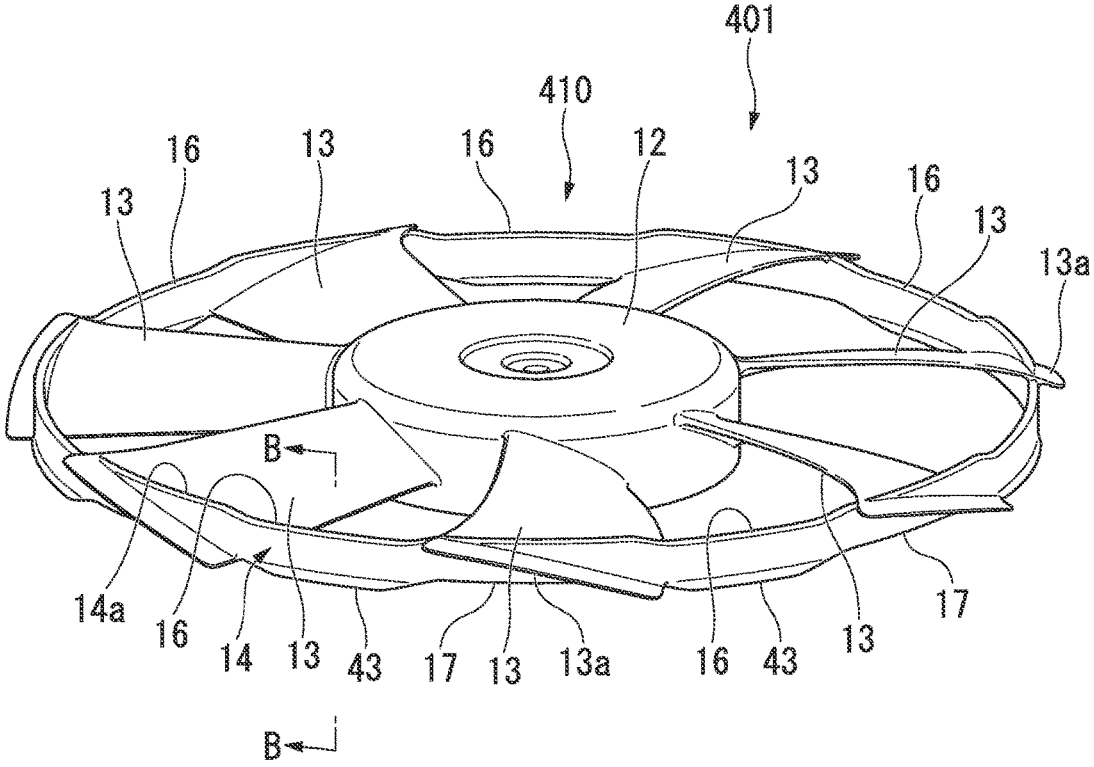
FIG. 10 is a perspective view of a fan main body of a cooling fan according to a fourth embodiment of the present invention.
Figure 11:
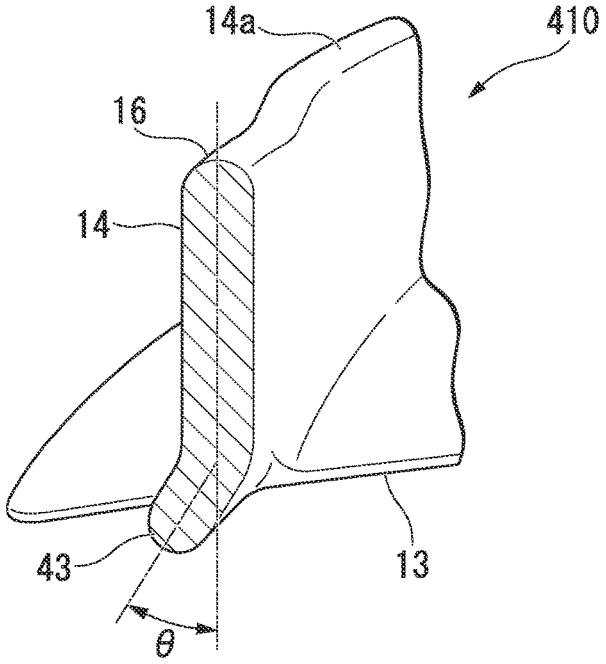
FIG. 11 is a cross-sectional view taken along line B-B of FIG. 10.

FIG. 10 is a perspective view showing a fan main body 410 of a cooling fan 401 of the fourth embodiment, and FIG. 11 is a cross-sectional view taken along line B-B of FIG. 10.

As shown in FIG. 10 and FIG. 11, the fourth embodiment is distinguished from the third embodiment in that, while the wall section 42 of the third embodiment extends in the axial direction from the base level 14*b* of the end section in the axial direction of the air ejection side of the ring member 14, a wall section 43 of the fourth embodiment curvedly extends to be inclined toward the outside from the base level 14*b* of the ring member 14 serving as a base point.

That is, the wall section 43 is formed to be inclined at an outward inclination by an angle θ with respect to the ring member 14. For this reason, the ring member 14 is formed in a shape that enlarges toward the air ejection side so that an opening area is gradually increased from the air suction side toward the air ejection side.

Figure 12:
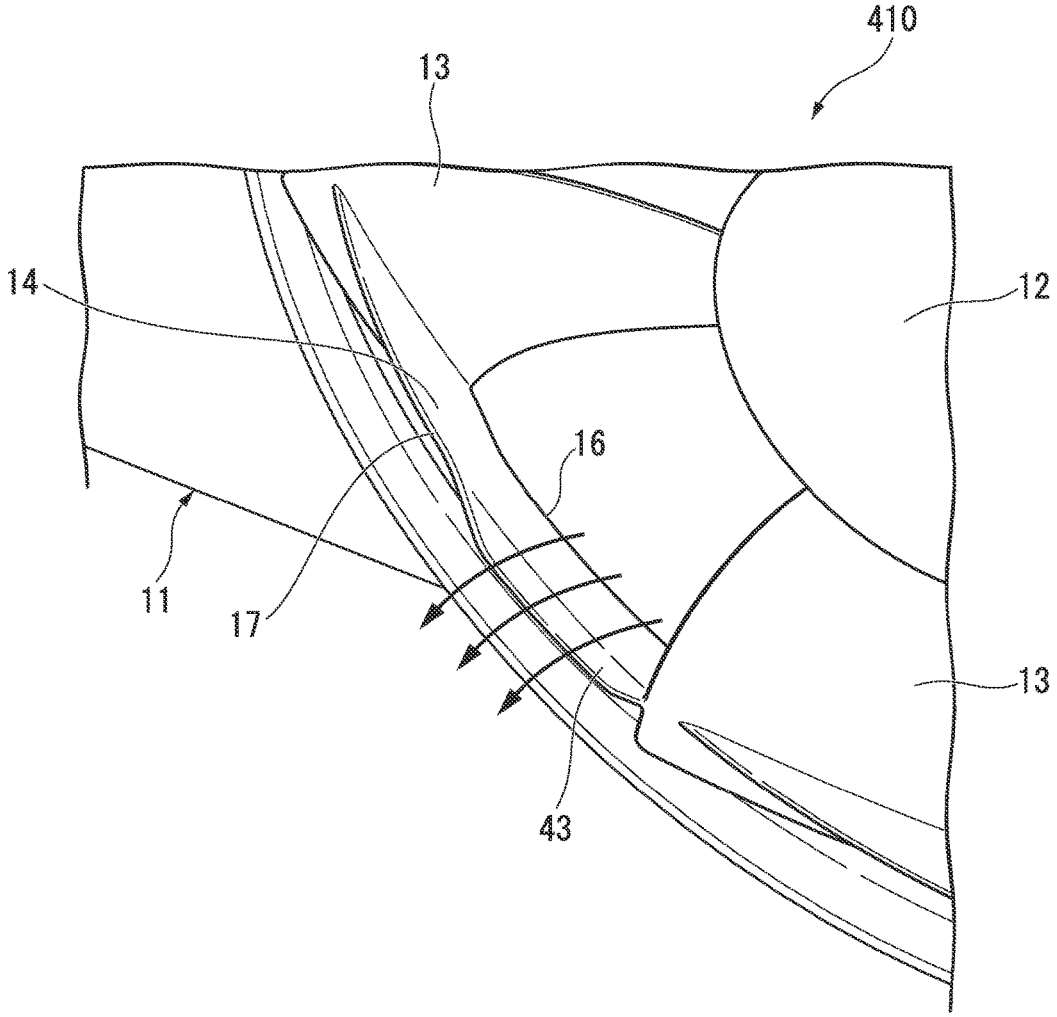
FIG. 12 is a view for describing a flow of air to the fan main body according to the fourth embodiment of the present invention.

FIG. 12 is a view for describing a flow of air when the fan main body 410 of the cooling fan 401 is rotary-driven.

As shown in FIG. 12, in the above-mentioned configuration, when the fan main body 410 of the cooling fan 401 is rotary-driven, the air from the air suction side (a rear side of FIG. 12) of the cooling fan 401 is suctioned into the space between the blades 13, and the air is discharged to the air ejection side (a front side of FIG. 12) of the fan main body 410. Here, since the opening area of the ring member 14 is gradually increased toward the air ejection side, a flow velocity of the ejected air is delayed at the air ejection side of the ring member 14. As a result, an air pressure by the cooling fan 401 can be increased.

Accordingly, in the cooling fan 401, in addition to the same effects as in the above-mentioned third embodiment, since the air pressure by the cooling fan 401 can be increased, the fan efficiency can be improved.

Here, an angle θ between the ring member 14 and the wall section 43 may be set within a range of 15 to 30 degrees. More specifically, a description will be made based on FIG. 13.

Figure 13:
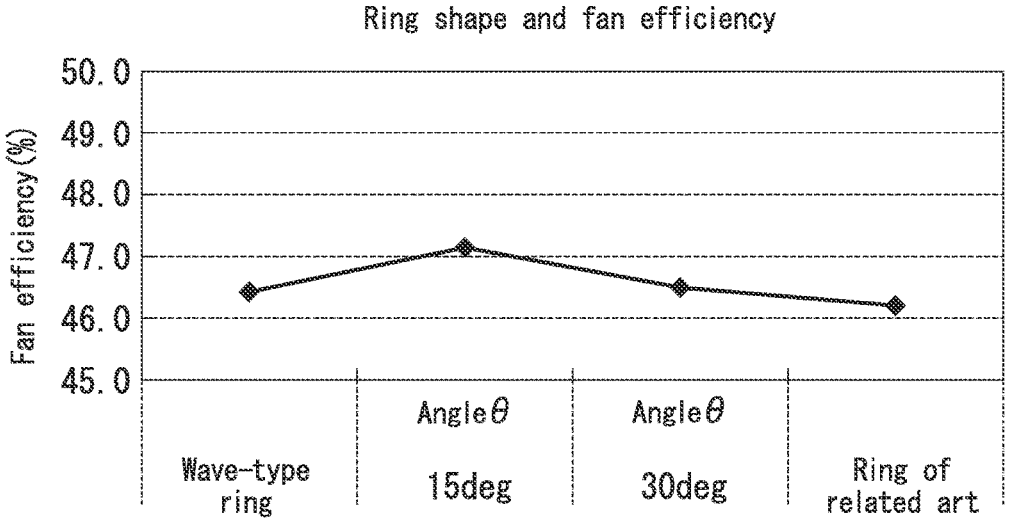
FIG. 13 is a graph showing a result obtained through examination of fan efficiency by varying an angle of a wall section according to the fourth embodiment of the present invention.

FIG. 13 is a graph of an experiment result in which fan efficiency is examined by varying the angle θ of the wall section 43.

As shown in FIG. 13, when the angle θ is set within a range of 15 to 30 degrees, it can be confirmed that fan efficiency is improved in comparison with that of the case of the related art or when there is no wall section 43 (wave-type ring).

In addition, the present invention is not limited to the embodiments but may be variously design-changed without departing from the spirit of the present invention. For example, in the embodiment, while the cooling fan is used to cool the radiator, the cooling fan according to the present invention is not limited to cooling the radiator but may be used to cool other instruments.

INDUSTRIAL APPLICABILITY

According to the present invention, since the air inlet groove is formed at the end section in the axial direction of the air suction side of the ring member, and the air flowing from the outer circumferential side is changed in the axial direction to be suctioned into the space between the blades, without abruptly turning through the air inlet groove of the ring member, an increase in the flow velocity of the air due to abrupt turning of the air can be suppressed, and generation of the noise can be prevented in advance. In addition, according to the present invention, since the air flowing from the outer circumferential side is suctioned between the blades through the air inlet groove without largely bypassing the end section in the axial direction of the ring member, the fan efficiency can be securely improved.

DESCRIPTION OF REFERENCE NUMERALS

1, 201, 301, 401 cooling fan
12 boss section
13 blade
14 ring member
16 air inlet groove

17 lightening groove
30 flow guide hole
42, 43 wall section

The invention claimed is:

1. A cooling fan, comprising:

a boss section connected to a rotary drive source;

a plurality of blades protruding outward from the boss section in a radial direction; and a cylindrical ring member configured to annularly connect the vicinities of end sections outside in the radial direction of the plurality of blades, wherein an air inlet groove is formed at an end section in an axial direction of an air suction side of the ring member, wherein a lightening groove is formed at an end section in the axial direction of the air ejection side of the ring member such that a position of the lightening groove is shifted in a circumferential direction of the ring member from a position of the air inlet groove, wherein the lightening groove has at least two lightening grooves that are adjacent to each other in the circumferential direction and are each formed to be recessed in the axial direction with respect to a base level part of the end section of the air ejection side of the ring member, the base level part being arranged at a farthermost position in the axial direction from the air suction side, and wherein, in the circumferential direction, at least a center position of a bottom section of the air inlet groove is disposed within the base level part between the two lightening grooves that are adjacent to each other in the circumferential direction.

2. The cooling fan according to claim 1, wherein the air inlet groove is disposed between front regions in the rotation direction of all of the blades on the ring member and front regions in the rotation direction of the blades adjacent thereto.

3. The cooling fan according to claim 2, wherein depths of the air inlet groove and the lightening groove are set to the same depth.

4. The cooling fan according to claim 1, wherein a ratio between the depth of the air inlet groove and a thickness in the axial direction of the ring member is set to a range of 0.10 to 0.40.

5. The cooling fan according to claim 1, wherein, at the end section in the axial direction of the air ejection side in the ring member, a wall section extending outward in the axial direction of a base level of the end section in the axial direction of the air ejection side in the ring member is formed at a place corresponding to a rear region in the rotation direction of the blade.

6. The cooling fan according to claim 5, wherein, when a height from the lightening groove to the base level of the end section in the axial direction of the air suction side of the ring member is set to h, a height from the air inlet groove to a front end of the wall section is set to a range of 1.2 h to 1.3 h.

7. The cooling fan according to claim 5, wherein the wall section curvedly extends from the base level of the end section in the axial direction of the air ejection side in the ring member serving as a base point.

8. The cooling fan according to claim 7, wherein an angle between the ring member and the wall section is set to a range of 15 to 30 degrees.

9. The cooling fan according to claim 5, wherein the wall section is formed between the rear regions in the rotation direction of all of the blades on the ring member and the lightening grooves formed at positions corresponding to the rear regions.

10. The cooling fan according to claim 1, wherein each of the blades is a forward-swept blade type in which an extending end side is curved toward a front side in the rotation direction of the blades, and wherein each of the blades has a swelling region that is formed such that an edge section of the front side in the rotation direction of the blades has a swelling amount to the front side that is increased toward the extending end.

11. The cooling fan according to claim 10, wherein the air inlet groove is formed between the swelling region of one of the blades and the swelling region of next adjacent one of the blades in the circumferential direction.

12. The cooling fan according to claim 11, wherein, when a rear surface of the blade is defined as a positive pressure surface and a front surface of the blade is defined as a negative pressure surface, the lightening groove is formed at a position facing the positive pressure surface of the blade, and wherein a position of a bottom part of the lightening groove is shifted in the circumferential direction from a position of a bottom part of the air inlet groove.

13. The cooling fan according to claim 12, wherein the air inlet groove is formed such that the bottom part of the air inlet groove is arranged in a circumferential region of the ring member where no blade is provided on.

14. The cooling fan according to claim 1, wherein the blade has a first part that is arranged between the boss section and the ring member, and a second part that is arranged protruding radially outward with respect to the ring member.

15. A cooling fan, comprising:

a boss section connected to a rotary drive source;

a plurality of blades integrally formed with the boss section and formed outward in a radial direction; and a cylindrical ring member configured to annularly connect end sections outside in the radial direction of the plurality of blades, wherein an air inlet groove is formed at an end section in an axial direction of an air suction side of the ring member, and wherein a lightening groove is formed at an end section in the axial direction of the air ejection side of the ring member such that a position of the lightening groove is shifted in a circumferential direction of the ring member from a position of the air inlet groove, wherein the lightening groove has at least two lightening grooves that are adjacent to each other in the circumferential direction and are each formed to be recessed in the axial direction with respect to a base level part of the end section of the air ejection side of the ring member, the base level part being arranged at a farthermost position in the axial direction from the air suction side, and wherein, in the circumferential direction, at least a center position of a bottom section of the air inlet groove is disposed within the base level part between the two lightening grooves that are adjacent to each other in the circumferential direction.

16. A cooling fan comprising:

a boss section connected to a rotary drive source;

a plurality of blades protruding outward from the boss section in a radial direction; and a cylindrical ring member configured to annularly connect the vicinities of end sections outside in the radial direction of the plurality of blades, wherein an air inlet groove is formed at an end section in an axial direction of an air suction side of the ring member, and wherein the air inlet groove is formed such that, in a circumferential direction of the ring member, a deepest bottom of the air inlet groove is positioned within a circumferential range where no blade is provided on.

17. The cooling fan according to claim 16, wherein each of the blades is a forward-swept blade type in which an extending end side is curved toward a front side in the rotation direction of the blades, and wherein each of the blades has a swelling region that is formed such that an edge section of the front side in the rotation direction of the blades has a swelling amount to the front side that is increased toward the extending end.

18. The cooling fan according to claim 17, wherein the air inlet groove is formed between the swelling region of one of the blades and the swelling region of next adjacent one of the blades in the circumferential direction.

19. The cooling fan according to claim 18, wherein, when a rear surface of the blade is defined as a positive pressure surface and a front surface of the blade is defined as a negative pressure surface, the lightening groove is formed at a position facing the positive pressure surface of the blade, and wherein a position of a bottom part of the lightening groove is shifted in the circumferential direction from a position of a bottom part of the air inlet groove.

20. The cooling fan according to claim 16, wherein the blade has a first part that is arranged between the boss section and the ring member, and a second part that is arranged protruding radially outward with respect to the ring member.

* * * * *